US009322545B2

(12) United States Patent
Wansor

(10) Patent No.: US 9,322,545 B2
(45) Date of Patent: Apr. 26, 2016

(54) SUPPLEMENTAL LIGHTING SYSTEM FOR IMPROVING VISIBILITY OF A PERSON ON A MOTORCYCLE

(71) Applicant: Scott Wansor, Blairsville, PA (US)

(72) Inventor: Scott Wansor, Blairsville, PA (US)

( * ) Notice: Subject to any disclaimer, the term of this patent is extended or adjusted under 35 U.S.C. 154(b) by 0 days.

(21) Appl. No.: 14/199,552

(22) Filed: Mar. 6, 2014

(65) Prior Publication Data

US 2014/0254143 A1 Sep. 11, 2014

Related U.S. Application Data

(60) Provisional application No. 61/774,472, filed on Mar. 7, 2013, provisional application No. 61/789,473, filed on Mar. 15, 2013.

(51) Int. Cl.

| | |
|---|---|
| ***F21V 21/08*** | (2006.01) |
| ***F21V 33/00*** | (2006.01) |
| ***A41D 13/01*** | (2006.01) |

(52) U.S. Cl.

CPC ..... *F21V 33/0008* (2013.01); *A41D 13/01* (2013.01); *A41D 2600/102* (2013.01)

(58) Field of Classification Search

CPC ..... F21V 33/0008; A41D 13/01; A41D 2600/102

USPC ..... 362/103

See application file for complete search history.

(56) References Cited

U.S. PATENT DOCUMENTS

| | | | | |
|---|---|---|---|---|
| 6,558,016 | B1 * | 5/2003 | Restauro | 362/103 |
| 7,109,857 | B2 * | 9/2006 | Ross et al. | 340/479 |
| 2009/0134992 | A1 * | 5/2009 | Pacheco et al. | 340/479 |

FOREIGN PATENT DOCUMENTS

| | | | |
|---|---|---|---|
| GB | 2411226 | A * | 8/2005 |
| WO | WO 2005020731 | A1 * | 3/2005 |

* cited by examiner

*Primary Examiner* — Elmito Breval
*Assistant Examiner* — Hana Featherly
(74) *Attorney, Agent, or Firm* — Nils H. Ljungman & Associates

(57) ABSTRACT

The disclosed invention is a system that provides high visibility for a motorcyclist (and possible passenger) in the form a jacket (or other garment). The jacket (or other garment) has lights, for example light-emitting diodes (LEDs), incorporated into the jacket at desired locations. The lights provide increased visibility of the person wearing the jacket, for example, a motorcyclist, particularly at night. In addition, the location, arrangement, and color of the lights (or sets of lights) can convey information (in addition to increasing the general visibility of the motorcyclist).

6 Claims, 2 Drawing Sheets

SUPPLEMENTAL LIGHTING SYSTEM FOR IMPROVING VISIBILITY OF A PERSON ON A MOTORCYCLE

CROSS-REFERENCE TO RELATED APPLICATIONS

This application claims benefit under 35 U.S.C. §119(e) of the earlier filing dates of U.S. Provisional Patent Application No. 61/774,472 filed on Mar. 7, 2013, and U.S. Provisional Patent Application No. 61/789,473 filed on Mar. 15, 2013, the entire contents of which are incorporated herein by reference.

FIELD OF THE INVENTION

This application discloses, generally and in various embodiments, an apparatus, system and method for improving the visibility of a person. The disclosed invention relates to a jacket (or other garment) with high visibility to provide improved safety and/or communication.

BACKGROUND

Given that the majority of vehicles on the road are automobiles and trucks, motorcyclists face a constant challenge of making sure that they are seen by other drivers to ensure the safety of all involved. This challenge is even more important when visibility is reduced, for example, by darkness (such as at night) or when weather conditions (such as fog) come into play. By improving the visibility of motorcyclists, accidents, injuries, and fatalities can be reduced.

In addition to improving the visibility of motorcyclists, there is also an opportunity to improve the ability of the motorcyclist to convey his or her traffic intentions and/or condition, which until now has been typically accomplished via the motorcycle-mounted brake lights, turn signals, and hazard flashers. Traditionally, brake lights and turn signals on a motorcycle are smaller than those on a typical automobile or truck, and they are relatively less visible because the motorcycle itself is smaller and the lights and signals tend to be closer to the ground (relative to lights and signals on automobiles and trucks). Accordingly, there is an opportunity for the motorcyclist to better convey his or her traffic intentions and/or condition by adding additional lighted indicators and positioning those lighted indicators at more visible locations.

SUMMARY

The disclosed invention is a system that provides high visibility for a motorcyclist (and possible passenger) in the form a jacket (or other garment). The jacket (or other garment) has lights, for example light-emitting diodes (LEDs), incorporated into the jacket at desired locations. The lights provide increased visibility of the person wearing the jacket, for example, a motorcyclist, particularly at night. In addition, the location, arrangement, and color of the lights (or sets of lights) can convey information (in addition to increasing the general visibility of the motorcyclist).

For example, red lights in a block or strip-type arrangement in the center of the back of the jacket can illuminate when the motorcyclist applies the brakes (the system detecting that the brakes have been applied), thereby indicating to anyone behind the motorcyclist that the motorcycle is slowing down or stopping. This function is similar to standard vehicle (and motorcycle) brake lights but the jacket provides added visibility to indicate braking.

Similarly, amber lights, for example, could be located on the shoulder area (rear, front, top, and/or sides) and/or the arms of the jacket (e.g., elbows and/or forearms). These amber lights can illuminate (e.g., flashing) when the motorcyclist activates the motorcycle turn signal (coordinated with, or independent of, the motorcycle turn-signal flash rate), thereby indicating to anyone in front, to the side, or behind the motorcyclist that the motorcycle is turning right or left, depending upon which lights are illuminated. The lights, for example, could be arranged to more clearly convey the intention, e.g., arranged to form a left-pointing arrowhead (for example, on the rear, upper left area of the jacket or other garment) to indicate a left turn, and a right-pointing arrowhead (for example, on the rear, upper right area of the jacket or other garment) to indicate a right turn. The respective lights on the jackets would activate when the turn signal is activated.

In addition, some or all of the amber lights can be illuminated (and flashing) to indicate the motorcyclist's activation of the hazard signal or four-way flasher. Again, the respective lights on the jackets would activate when the hazard signal or four-way flasher is activated, and may be coordinated with, or independent of, the motorcycle hazard-signal flash rate.

A control unit coupled to the motorcycle, for example, detects the activation of the brake, the turn-signal, the hazard signal, the headlight, running lights, etc. on the motorcycle and conveys that information to the jacket (or other garment), via wireless communication (or a wired releasable connection between the motorcycle and the jacket (or other garment)). The wireless communication scheme can apply any suitable technique, analog, digital or otherwise, be it radio frequency (e.g., Bluetooth or other short-range communication protocol), infrared, or other available communication technique. The jacket (or other garment) receives the information and illuminates the corresponding lights, for example, the designated brake lights on the jacket (or other garment) when the brakes are applied, and then extinguishes the brake lights on the jacket (or other garment) when the brakes are released.

The communication scheme may be bidirectional (e.g., two-way) or unidirectional, for example, from the control unit to the jacket (or other garment). The communication scheme may also provide additional functionality, for example, sounding the motorcycle horn to attract attention in the event the motorcyclist is in distress, e.g., involved in an accident. The communication scheme may also provide a cellular, satellite or other suitable signal to summon emergency response services in such a situation.

The system can account for multiple riders so that, for example, the lights on the jacket of the motorcycle driver may not illuminate when there is a passenger with an equipped jacket (or other equipped garment) behind the motorcycle driver. In this way, the lights on the back of the motorcycle driver's jacket will not be blocked from view by the presence of the passenger, and the lights on the passenger's jacket (or other garment) will assume the role. In addition, certain lights on both jackets (or other garments) may be selected to operate at the same time, thereby providing added visibility, for example, from the sides and/or front (in addition to the rear). Selecting certain lights to not illuminate may be desirable, for example, to preserve electrical power, and so that the lights do not disturb the passenger or interfere with his or her vision.

The jacket (or other garment), if coupled wirelessly to the motorcycle, will typically operate on battery power. The battery power may be provided by any suitable type (e.g., rechargeable) and number of batteries. In addition, the opportunity to charge the batteries from a solar energy source (during daylight hours) or other means is expressly contemplated.

While this invention has been described in the context of a motorcycle jacket (or other garment), other applications and embodiments are contemplated. For example, a suitable version could be used by police, border patrol, and other law enforcement officials, to increase their visibility, for example, at traffic stops, accident scenes, checkpoints, or roadblocks, but also to make them more visible and identifiable from the air (e.g., a helicopter) to assist and guide them in a search or rescue, for example. In such examples, the control unit would not necessarily be coupled to a motorcycle.

Similarly, a version of the invention could be incorporated into a life jacket to make boaters or airline passengers in distress more visible in, for example, a rescue scenario.

A version of the invention could likewise be used by flight support and operations personnel on aircraft carriers, at airports, or the like.

In addition, this invention is not limited to jackets; vests are another example of a garment specifically contemplated by this invention. A vest, for example, would have brake lights similar to that described for a jacket but would have the turn-signal lights positioned, for example, between the neck and the shoulders (since there are no arms, as in the examples of a jacket). A vest could be made of any material, e.g., leather, or it could be made of a lighter-weight mesh material, for example, so that law enforcement officers could don it over their uniforms when responding, for example, to a vehicular accident scene.

Chaps are another example of garments other than jackets that are within the scope of this invention. Running lights, or turn-signal or hazard lights could be incorporated into chaps (for example, along the outside of the legs) to improve the visibility of motorcyclists and the ability of the motorcyclist to convey his or her traffic intentions and/or condition. Lights could also be incorporated into gloves (another type of garment) to improve the visibility of motorcyclists (particularly from the front) and the ability of the motorcyclist to convey his or her traffic intentions and/or condition (e.g., communicating his or her intention to turn, to oncoming and/or cross-traffic).

The various numbers, colors, and arrangements of the lights on the jacket (or other garment) provide virtually unlimited possibilities. For example, lights can be arranged on the back of the jacket (or other garment) in the pattern of a skull with, for example, the skull illuminating when the brakes are applied, and the left and right eyeballs (or eye sockets) illuminating for the left and right turn-signals, respectively.

As another example, the lights could be arranged on the back of the jacket (or other garment), for example, in the pattern of an alien head with alien head illuminating when the brakes are applied, and hovering UFOs (for example, one on the left rear shoulder and one on the right) illuminating for the left and right turn-signals, respectively.

As another example, the lights could be arranged on the back of the jacket (or other garment) as a programmable message panel so that, for example, words or symbols could be displayed at desired times. For example, lights could illuminate to spell the word "BRAKE" (or display an image of a stop sign) when the brakes are applied, or the word "SLOW" if the brakes are applied to slow down but not stop. The lights on such a message panel could, for example, spell out "TURNING LEFT" or "TURNING RIGHT" or "HAZARD," (or display a triangular hazard symbol in amber, for example).

In addition to improving the visibility of motorcyclists and the ability of the motorcyclist to convey his or her traffic intentions and/or condition, the message panel could, for example, display messages intended for drivers or other motorcyclists, such as "EXITING NOW" or "PULLING OVER." The message panel could also be used to promote or advertise affiliations or affinities (e.g., clubs, sponsors, nicknames, favorite sports teams), or commercial-type messages, (e.g., company or product names, logos, or other images).

Separate from the message panel examples, a jacket (or other garment) can be customized with lights to display virtually any desired design or arrangement to, for example, promote or advertise affiliations or affinities (e.g., clubs, sponsors, nicknames, favorite sports teams) or commercial-type messages, (e.g., company or product names, logos, or other images). These examples illustrate the breadth, but do not limit the scope, of invention described and claimed herein.

BRIEF DESCRIPTION OF THE DRAWINGS

The disclosed invention will be better understood by way of reference to the detailed disclosure below and to the accompanying drawings, wherein.

DETAILED DESCRIPTION OF EXAMPLE EMBODIMENTS

Figure 1:
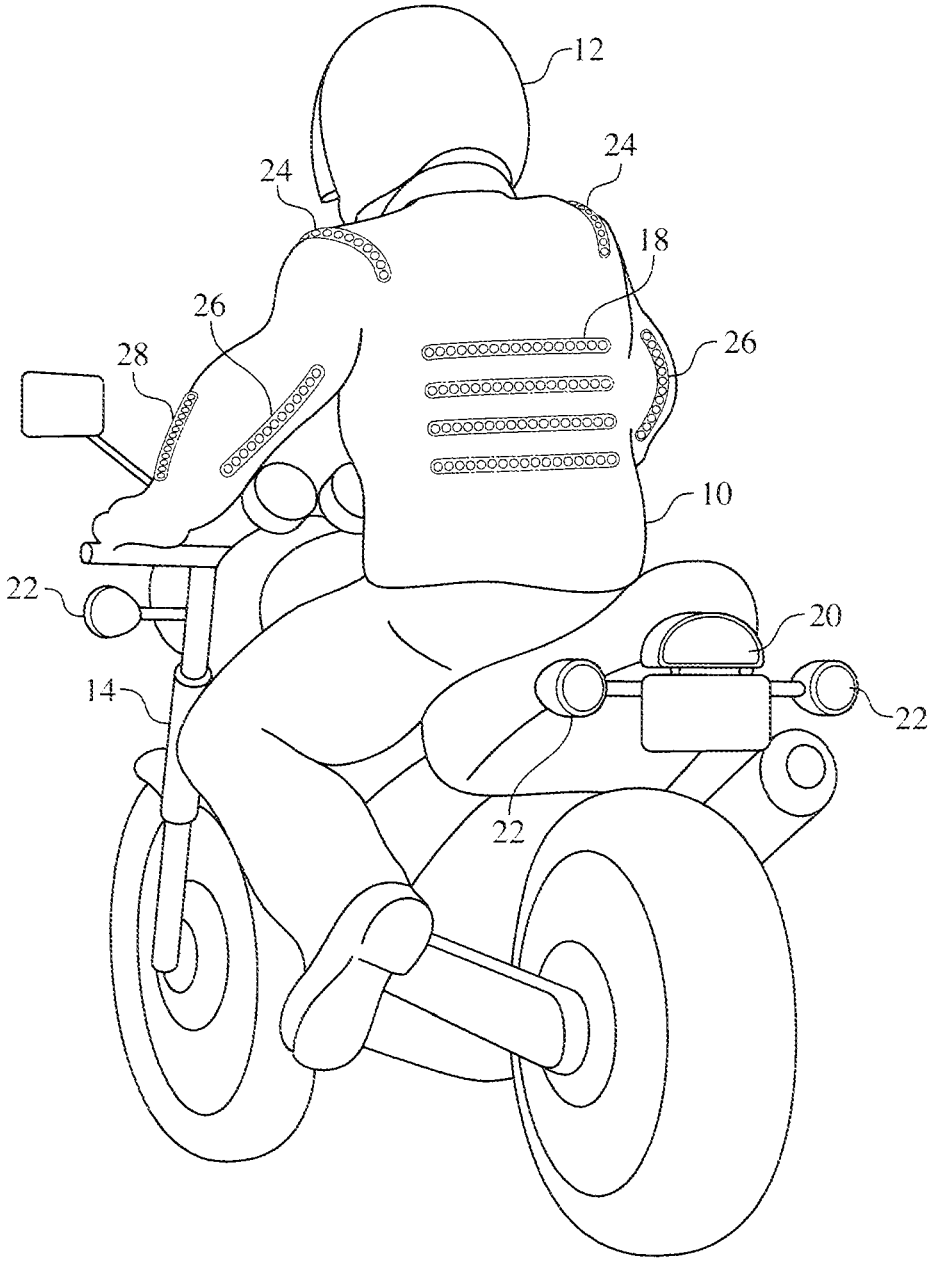
FIG. 1 is a side elevational view of a motorcyclist on a motorcycle, wearing one example of a high-visibility jacket.

FIG. 1 shows a motorcyclist 12 positioned on a motorcycle 14 wearing one example of a high-visibility jacket 10. Coupled to the motorcycle 14 is a control unit 16 (hidden from view in FIG. 1) which detects the application of the brakes, the turn signals, running lights, head lights, and/or the hazard signal or four-way flasher, and conveys that information to the jacket 10 so that respective lights on the jacket 10 will illuminate.

FIG. 1 shows, as an example, the use of red lights 18 located in the back, center portion of the jacket 10, which can be illuminated when the brakes are applied. While the brake lights 20 on the motorcycle 14 will operate as they normally would, illuminating the red lights 18 on the jacket 10 provide added visibility, and convey to anyone behind the motorcycle 14 that the motorcycle 14 is slowing down or stopping.

FIG. 1 also shows, as an example, the use of amber lights which can be illuminated when the turn signals 22 and/or hazard signal or four-way flashers are activated. In the example shown in FIG. 1, the amber lights on the jacket 10 are located on each shoulder 24, and on the sleeves behind each elbow 26 and on the forearms 28. Of course, other configurations are possible, and may be desirable. For example, lights on the jacket 10 could be arranged in the back of the jacket 10 as arrowheads behind each shoulder, a left-pointing arrowhead behind the left shoulder, and a right-pointing arrowhead behind the right shoulder, for left-turn and right-turn indications, respectively. Of course, lights other than red or amber may be utilized.

Figure 2:
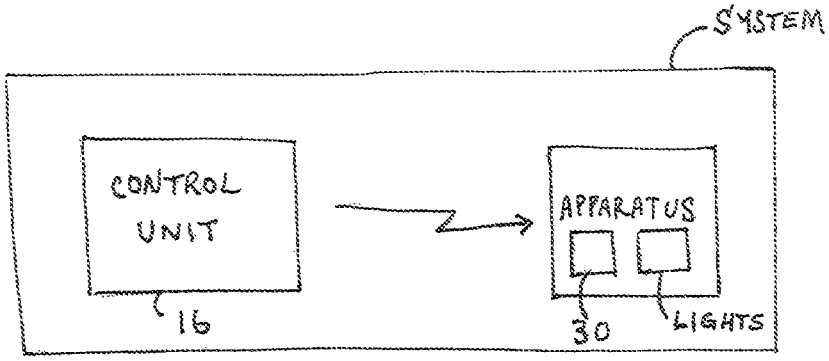
FIG. 2 illustrates the disclosed system and apparatus.

FIG. 2 shows the system and apparatus. As an example, a system includes a control unit 16 (including a wireless transmitter) that is installed (for example) on the motorcycle 14, and a module (including a receiver) 30 that is installed (for example) in jacket (or other garment) 10. Although the control unit 16 and the module 30 can be configured so that each transmits and receives, in this example, the control unit 16 transmits and the module 30 receives.

Electrically the control unit 16 is connected to the motorcycle's 14 wiring. Typically, there are inputs to the control unit 16 such as brake wire, left-turn signal wire, right-turn signal wire, running light wire, +12-volt wire, and a ground wire. These inputs are coupled to the motorcycle's 14 wiring harness with, for example, splice connectors. By detecting which motorcycle 14 wires are energized, the control unit 16 determines which lights are activated. For example, as the motorcyclist 12 engages the brake, the brake wire on the motorcycle 14 is energized with 12 volts to illuminate the motorcycle's 14 brake light. Since the control unit's 16 brake wire input is coupled to the brake wire on the motorcycle 14, it detects the brake light is activated. Just before the control unit 16 transmits, it determines which lights on the motorcycle 14 are activated and constructs a packet to transmit that data to the module 30.

The control unit 16 includes a wireless transmitter operating, for example, in the approximately 900 MHz ISM radio band. In this example, roughly ten times per second, the control unit 16 sends a packet of information which primarily contains the control unit's 16 serial number and light status of the motorcycle 14 (e.g., whether the brake light, running light, right-turn and left-turn signals are activated). Modules 30 receiving the packet will first verify the packet was sent from a control unit 16 for which they are listening (using the control unit 16 serial number sent in the packet). If the received packet was from the control unit 16 for which the module 30 was listening, the module 30 will activate the corresponding lights (if enabled) on the jacket 10.

In this example, three push buttons on the module 30 are used: (1) power on/off switch; (2) "brake light disable," to disable the brake light on the jacket 10 when, for instance, a passenger is riding behind the motorcyclist 12 with a jacket 10; and (3) "sync" function to link the module 30 with the desired control unit 16.

An example to illustrate the "sync" function is as follows: when the "sync" button is pressed, the module 30 listens for a "beacon signal" from a desired control unit 16 within range that is connected to a motorcycle 14 that has all three lights on (brake, left-turn, and right-turn signals), an indication that the motorcycle 14/control unit 16 is available for syncing. If the beacon signal is received by the intended module 30, the control unit's 16 serial number (included in the beacon signal) is stored in the module's 30 memory and that control unit 16 becomes the designated control unit 16 for which the module 30 listens. In this example, the module 30 is synced to that control unit 16.

An example of the operation is as follows: When first turned on, the module 30 goes into a SCAN state for roughly two minutes. In this state it listens for a transmission from the designated control unit 16. If it receives a valid signal in that time period, it enters IDLE or ACTIVE mode. Otherwise, it times-out and turns itself off (SLEEP mode).

In this example, IDLE mode refers to the mode in which the module 30 received a valid transmission (e.g., containing the serial number for the synced control unit 16) while in the SCAN state but for which none of the "light status" bits were active (e.g., indicating that the brake lights or turn-signal lights on the motorcycle 14 were activated). In IDLE mode, the receiver enters a low-power state until just before the control unit 16 is scheduled to transmit. This is done to conserve battery power. The module 30 goes back into the low-power mode once it receives the control unit's 16 transmission. If it misses a transmission, it reverts to SCAN mode.

If the transmission from the control unit 16 indicates that a light on the motorcycle 14 is active, the unit enters ACTIVE mode. This mode is nearly identical to IDLE, except that control unit 16 detected that one or more lights on the motorcycle 14 has been is activated, and the appropriate lights on the jacket 10 will be (or remain) illuminated. If the transmission from the control unit 16 indicates that all lights on the motorcycle 14 are off, the module 30 reverts to IDLE mode.

In this example, the module 30 operates on three AA batteries (e.g., NiCad, NiMH, or alkaline). It has three LED indicators beside the push buttons to indicate what mode it is in, and the battery level.

With the control unit 16 broadcasting, there is theoretically no limit to the number of jackets modules 30 that can receive it. As a practical matter, however, there is a limited number of people with equipped jackets 10 who would fit within the very low-power transmit range of the control unit 16.

There are several techniques that can be used to minimize wireless unwanted interference and maximize the number of different control unit 16/jacket 10 combinations that can be used in one area without interfering with one another. One technique is low-duty cycle.

In this example, "duty cycle" refers to the percentage of time the control unit 16 spends transmitting. If the control unit 16, for example, were to transmit for one second every three seconds, it would be said to have a 33% duty cycle. With a 33% transmit duty cycle, there is an increased probability that two different control units 16 would be transmitting at the same time. One way to reduce the probability of such interference is to reduce the duty cycle to approximately one percent, i.e., transmitting for less than one millisecond every 100 milliseconds. This reduces the chance of overlap and/or unwanted interference.

Another technique that can be used to minimize unwanted interference and maximize the number of different control unit 16/jacket 10 combinations that can be used in one area is changing time base. Even with a low duty cycle, there's a chance that two different control units 16 could be transmitting at the same time, in the same vicinity, resulting in interference. To address this, the base transmission period (approximately 100 ms) is varied by small amounts each transmission. This ensures a wireless transmission collision occurs only once (if at all). Upon the next transmission, the two control units 16 will be transmitting at different (i.e., changed) times. The time variation is dictated, for example, by the control unit's 16 serial number to ensure the sequence is unique and the potentially interfering control units 16 do not just both change the time base by the same amount (which would result in continuing interference).

Another technique that can be used to minimize unwanted interference and maximize the number of different control unit 16/jacket 10 combinations that can be used in one area is using a large channel count. Interference can be avoided if each control unit 16 transmits on a unique channel. As a practical matter, there is a finite number of channels that can be used, however, the larger the number of unique channels used with the control units 16, the lower the risk of unwanted interference.

These are examples of techniques can be used to minimize unwanted interference and maximize the number of different control unit 16/jacket 10 combinations that can be used in one area. One or more of these techniques (or others), in combination with using low transmit power, increases the number of control units 16 within a given area with little or no interference.

Also, a push button on the control unit 16 may be used to change the transmit channel. In this example, it is intended to be used rarely, only if there is some interference (e.g., a cell phone) on that channel.

What is claimed is:

1. A system for improving the visibility of a person on a motorcycle, comprising:

a garment to be worn by the person, the garment having one or more lights embedded therein;

a receiver module disposed on the garment, wherein the receiver module activates the one or more lights embedded into the garment;

a control unit, to be coupled to the motorcycle, wherein the control unit detects the activation of certain of one or more lights on the motorcycle, wherein the control unit includes a wireless transmitter that wirelessly communicates information regarding the activation of certain of one or more lights on the motorcycle to the receiver module whereby certain of the one or more lights embedded into the garment corresponding to certain of one or more lights on the motorcycle are illuminated at desired times by the receiver module.

2. The system of claim 1, wherein certain of one or more lights embedded into the garment are illuminated in response to information wirelessly communicated by the control unit to the receiver module to indicate that the motorcycle will be, or is, turning.

3. The system of claim 1, wherein certain of one or more lights embedded into the garment are illuminated in response to information wirelessly communicated by the control unit to the receiver module to indicate that the motorcycle will be, or is, slowing down or stopping.

4. The system of claim 1, wherein the control unit is configured to send a packet of information including a serial number associated with the control unit, and a status corresponding to certain of one or more lights on the motorcycle.

5. The system of claim 4, wherein the receiver module is configured to receive the packet and activate certain of one or more lights embedded into the garment upon verification that the serial number sent in the packet is for the control unit coupled to the motorcycle.

6. The system of claim 5, wherein the receiver module is further configured to sync to the control unit to link the receiver module to the control unit coupled to the motorcycle.

* * * * *